US010919289B2

(12) United States Patent
Schwab

(10) Patent No.: US 10,919,289 B2
(45) Date of Patent: Feb. 16, 2021

(54) PRINTING MACHINE WITH A TWIN PRINTING UNIT AND METHOD FOR OPERATING SUCH A PRINTING MACHINE

(71) Applicant: HEIDELBERGER DRUCKMASCHINEN AG, Heidelberg (DE)

(72) Inventor: Werner Schwab, Bechtsrieth (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 204 days.

(21) Appl. No.: 16/037,185

(22) Filed: Jul. 17, 2018

(65) Prior Publication Data

US 2019/0016111 A1 Jan. 17, 2019

(30) Foreign Application Priority Data

Jul. 17, 2017 (DE) ..... 10 2017 212 183
Dec. 14, 2017 (DE) ..... 10 2017 222 700

(51) Int. Cl.

| | |
|---|---|
| ***B41F 3/12*** | (2006.01) |
| ***B41F 23/04*** | (2006.01) |
| ***B41F 5/24*** | (2006.01) |
| ***B41F 5/06*** | (2006.01) |

(52) U.S. Cl.

CPC ..... *B41F 23/0409* (2013.01); *B41F 3/12* (2013.01); *B41F 5/06* (2013.01); *B41F 5/24* (2013.01)

(58) Field of Classification Search

CPC ..... B41F 3/12; B41F 3/14; B41F 3/16; B41F 3/18; B41F 5/06; B41F 5/10; B41F 5/24; B41F 7/04; B41F 7/10; B41F 7/14; B41F 3/52; B41F 3/54; B41F 5/08; B41F 5/18; B41F 13/18; B41F 23/0409; B41F 23/0403

USPC ..... 101/219, 228

See application file for complete search history.

(56) References Cited

U.S. PATENT DOCUMENTS

| | | | | |
|---|---|---|---|---|
| 2,649,734 A * | 8/1953 | Ras | B41F 5/18 | 101/138 |
| 3,416,444 A * | 12/1968 | Cahn | B41F 13/025 | 101/181 |
| 4,729,309 A | 3/1988 | Saterini et al. | | |
| 5,191,836 A * | 3/1993 | Weis | B41F 13/24 | 101/219 |
| 5,447,101 A * | 9/1995 | Weis | B41F 5/24 | 101/219 |

(Continued)

FOREIGN PATENT DOCUMENTS

| | | |
|---|---|---|
| DE | 10343411 B4 | 7/2009 |
| EP | 0234456 A2 | 9/1987 |

(Continued)

*Primary Examiner* — Matthew G Marini
*Assistant Examiner* — Marisa Ferguson-Samreth
(74) *Attorney, Agent, or Firm* — Laurence A. Greenberg; Werner H. Stemer; Ralph E. Locher

(57) ABSTRACT

A printing machine for printing on a web of printing material includes a plurality of in-line flexographic printing units disposed in a plane that is accessible to a machine operator. Every two flexographic printing units of the plurality of flexographic printing units together form a double printing station and the two flexographic printing units of a respective double printing station have a common impression cylinder. A method of operating a printing machine is also provided.

22 Claims, 8 Drawing Sheets

(56) References Cited

U.S. PATENT DOCUMENTS

| | | | | |
|---|---|---|---|---|
| 5,503,069 | A | 4/1996 | Blim | |
| 5,528,986 | A * | 6/1996 | Andersson | B41F 13/20 101/219 |
| 5,692,442 | A * | 12/1997 | Leanna | B41F 5/24 101/247 |
| 6,443,058 | B1 * | 9/2002 | Stadler | B41F 11/00 101/142 |
| 7,690,099 | B2 | 4/2010 | Bapst et al. | |
| 8,943,939 | B2 | 2/2015 | Demand | |
| 2006/0156934 | A1 | 7/2006 | Arabin et al. | |
| 2009/0078135 | A1 * | 3/2009 | Bangel | B41F 5/24 101/177 |
| 2013/0264410 | A1 * | 10/2013 | Schnabel | B65H 23/26 242/410 |
| 2014/0071197 | A1 * | 3/2014 | Chiwata | B41J 11/0085 347/18 |
| 2018/0304612 | A1 * | 10/2018 | Muller | B41F 31/002 |

FOREIGN PATENT DOCUMENTS

| | | | |
|---|---|---|---|
| EP | 1731277 | B1 | 11/2011 |
| EP | 2551078 | A1 | 1/2013 |

* cited by examiner

PRINTING MACHINE WITH A TWIN PRINTING UNIT AND METHOD FOR OPERATING SUCH A PRINTING MACHINE

CROSS-REFERENCE TO RELATED APPLICATION

This application claims the priority, under 35 U.S.C. § 119, of German Patent applications DE 10 2017 212 183.1, filed Jul. 17, 2017 and DE 10 2017 222 700.1, filed Dec. 14, 2017; the prior applications are herewith incorporated by reference in their entirety.

BACKGROUND OF THE INVENTION

Field of the Invention

The invention relates to a printing machine for printing on a web of printing material, the printing machine including a plurality of in-line flexographic printing units disposed in a plane accessible to a machine operator. The invention also relates to a method for operating a printing machine for printing on a web of printing material.

Description of the Related Art

Printing machines constructed or used for packaging printing are faced with more and more demanding challenges in terms of productivity, ease of operation, and maximum production variability. For instance, a printing machine is expected to produce as little waste as possible, for instance when it is reconfigured between print jobs. Common machine constructions for packaging printing, in particular flexographic printing, are web-fed printing machines of in-line construction including a plurality of cylinders and rollers for guiding a printing material between different process levels (for instance printing and drying). That means that a web section of considerable length is present in the machine and a corresponding amount of unusable products may be created.

Machines for the printing and rotary die-cutting of folding box blanks in an in-line process have become known in the art, for instance from European Patent EP 1 731 277 B1, corresponding to U.S. Pat. No. 7,690,099. Those web-fed printing machines include multiple printing units to print on a web-shaped substrate, potentially using different printing processes. The web of printing material is subsequently subjected to further processing, e.g. die-cutting embossing, varnishing, etc.

German Patent DE 103 43 411 B4, corresponding to U.S. Publication No. 2006/0156934, discloses a rotary printing machine including a plurality of printing units that may be equipped with so-called sleeves for a quick job change. For that purpose, a motor is provided to move the axles of the sleeves into a change position in which the axles are easily accessible. Once the sleeves have been changed, the sleeves and the axles are jointly returned from the change position to an operating position.

A disadvantage of those prior art machines is that the printing operation needs to be stopped for a sleeve change, resulting in times of standstill and affecting the productivity of the machine. If a color change is required, longer periods of standstill are required. In addition, start-up waste, i.e. a printed web section that is unusable, is created after every standstill.

SUMMARY OF THE INVENTION

It is accordingly an object of the invention to provide a printing machine with a twin printing unit and a method for operating such a printing machine, which overcome the hereinafore-mentioned disadvantages of the heretofore-known machines and methods of this general type and which are suitable for quick and easy job changes with as little waste as possible.

With the foregoing and other objects in view there is provided, in accordance with the invention, a printing machine for printing on a web of printing material, in particular a web made of paper, cardboard, or plastic, including a plurality of flexographic printing units in an in-line configuration. Due to this in-line configuration, the printing machine may be expanded as desired. The flexographic printing units are disposed in a plane that is accessible to the operator, in particular in a level and horizontal plane and at a level that is easily accessible to the operator in an ergonomic way. Every two flexographic printing units advantageously form a double printing station. The two flexographic printing units of a printing station have a common impression cylinder. This printing station construction may be referred to as a twin printing unit or double ink deck (DID) in contrast to a so-called single ink deck (SID).

In accordance with a preferred embodiment, the two flexographic printing units of a respective double printing station may be operated in an alternate way. This enables continuous production, i.e. an on-the-fly job change. Alternatively, the two flexographic printing units may be operated together.

In accordance with an advantageous further development of the printing machine of the invention, the two flexographic printing units of each double printing station are disposed to be mirror-symmetrical relative to the common impression cylinder. While one flexographic printing unit is printing, the other flexographic printing unit may undergo set-up or maintenance operations.

In accordance with a particularly advantageous and thus preferred embodiment, a drier is provided downstream of every double printing station. An advantage of this configuration is that once ink has been applied, the applied amount of ink may be dried completely, allowing the web of printing material to be diverted in a trouble-free way without smearing. Alternatively, a provision is made for every double printing station to include at least one drier, preferably two or four driers.

It is also preferred that the drier is a UV drier or that the driers are UV driers. It is further preferred that the common impression cylinder of a respective double printing station is a cooling cylinder.

In accordance with a particularly advantageous and thus preferred embodiment, a provision is made for every double printing station to include the following elements successively disposed along the circumference or on the periphery of the cooling cylinder in the direction of printing material transport: a flexographic printing unit; one or two UV driers; a flexographic printing unit; and one or two UV driers.

It is furthermore advantageous if a respective flexographic printing unit is equipped with an ink application device and a flexographic cylinder with a print sleeve carrying the printing master.

In practice, it has been found to be advantageous for the circumference of a respective impression cylinder to be smaller than 1000 mm (in the case of hot-air drying).

In accordance with a particularly advantageous and thus preferred embodiment, a provision is made for at least one further flexographic printing unit to be provided in addition to the plurality of flexographic printing units and in the form of a single printing station.

In accordance with a particularly advantageous and thus preferred embodiment, a provision is made for the single printing station to be disposed upstream of the plurality of printing units or for the single printing station to be disposed downstream of the plurality of flexographic printing units.

In accordance with a particularly advantageous and thus preferred embodiment, a provision is made for the single printing station to be disposed downstream of the double printing station or downstream of a last double printing station as viewed in the direction of printing material transport.

In accordance with a particularly advantageous and thus preferred embodiment, a provision is made for the impression cylinder of the single printing station to be embodied as a cooling cylinder and for the following elements to be successively disposed along the circumference or on the periphery of the cooling cylinder in the direction of printing material transport: a flexographic printing unit; and one or two UV driers.

In accordance with a particularly advantageous and thus preferred embodiment, a provision is made for a section—or all sections—of the web of printing material a) between two double printing stations and/or b) between the double printing station—or a last double printing station—and the single printing station, to run in a second plane substantially located beneath the first plane.

In accordance with a particularly advantageous and thus preferred embodiment, a provision is made for the length of the section of the printing material or of all sections of the printing material to be smaller than the length of the printing material in a double printing station.

In accordance with a particularly advantageous and thus preferred embodiment, a provision is made for the web of printing material in every double printing unit to form a loop extending from the second plane and being open in a downward direction.

In accordance with a particularly advantageous and thus preferred embodiment, a provision is made for the loop to run around the impression cylinder and around at least two or three guide rollers disposed between the first plane and the second plane.

In accordance with a particularly advantageous and thus preferred embodiment, a provision is made for the last double printing station to be followed by a single printing station and a hot-air drier succeeding one another in the direction of printing material transport.

With the objects of the invention in view, there is also provided a method for operating a printing machine as described above for printing on a web of printing material. In accordance with the invention, a maximum of one flexographic printing unit of the two flexographic printing units of a respective double printing station is activated to print on the web of printing material. The respective other flexographic printing unit, i.e. the inactive printing unit of a double printing station, may advantageously be subjected to set-up or maintenance operations or may be in an inactive stand-by position. Set-up operations may, for instance, include a printing sleeve change or an ink change. This is an easy way to use and exchange special colors. Maintenance operations may for instance include a blade change on the doctor blade.

In a particularly advantageous and thus preferred further development of the method of the invention, the flexographic printing units of a respective double printing station may be activated and deactivated in an in-register way to enable on-the-fly flexographic printing unit changes upon a job change. This means that when a printing station is switched from one flexographic printing unit to the other flexographic printing unit to implement a job change, the flexographic printing units of the different printing stations are synchronized with each other so as to avoid the production of waste in between jobs and to allow the web of printing material to be continuously printed on.

Alternatively, a method of the invention may also include provisions for both flexographic printing units of a printing station to be activated and to print on the web of printing material. In accordance with this alternative, a machine that has four printing stations, for instance, may print eight colors instead of just four.

Other features which are considered as characteristic for the invention are set forth in the appended claims.

Although the invention is illustrated and described herein as embodied in a printing machine with a twin printing unit and a method for operating such a printing machine, it is nevertheless not intended to be limited to the details shown, since various modifications and structural changes may be made therein without departing from the spirit of the invention and within the scope and range of equivalents of the claims. As far as it makes sense from a technical point of view, combinations of the invention as described above and of the advantageous further developments of the invention likewise form advantageous further developments of the invention.

The construction and method of operation of the invention, however, together with additional objects and advantages thereof will be best understood from the following description of specific embodiments when read in connection with the accompanying drawings. Further advantages and embodiments of the invention that are advantageous in structural and functional terms will become apparent from the dependent claims and the description of exemplary embodiments with reference to the appended figures.

DETAILED DESCRIPTION OF THE INVENTION

Figure 3:
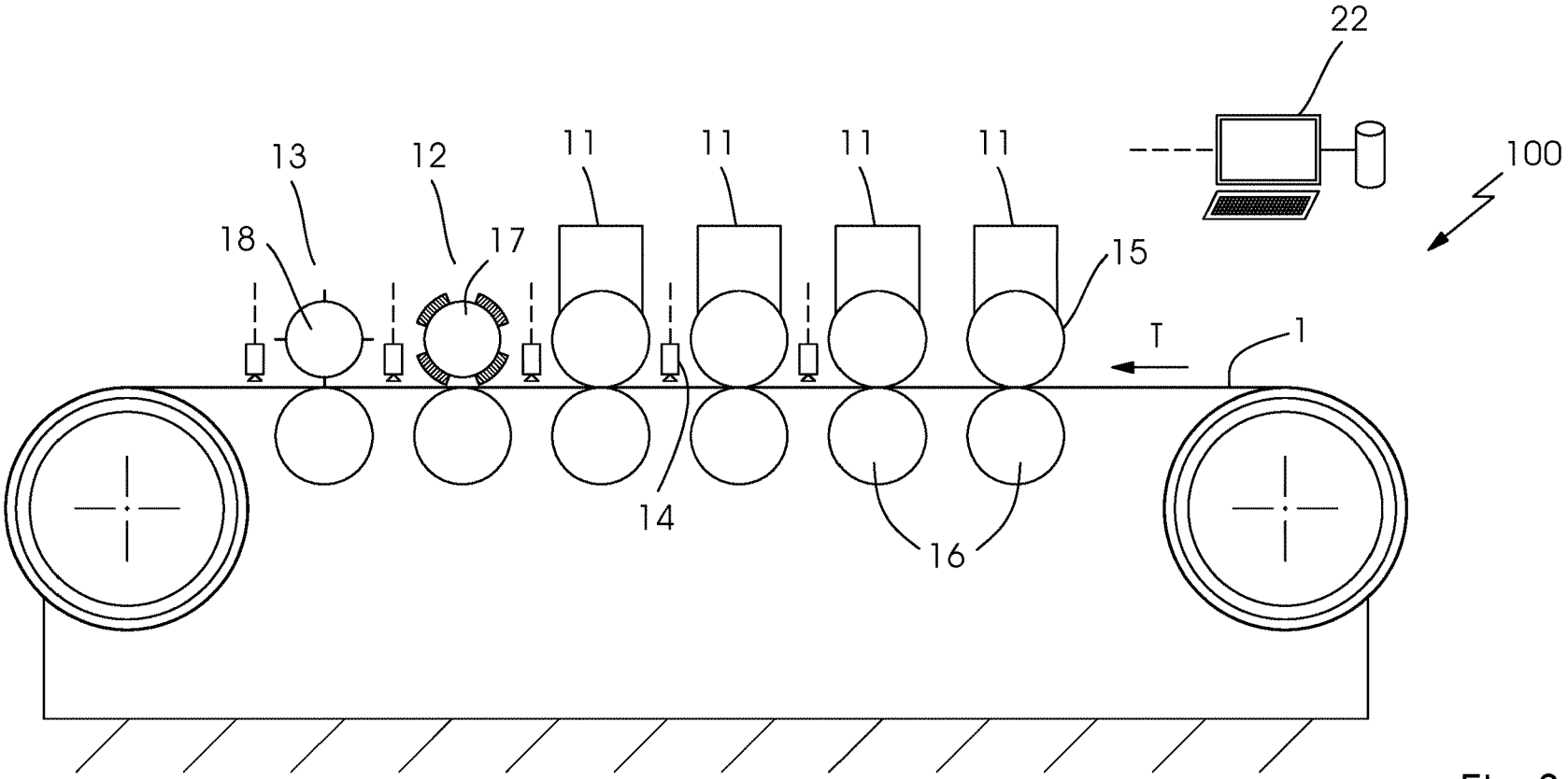
Fig.3 PRIOR ART
FIG. 3 is a longitudinal-sectional view of a web-fed printing machine in accordance with the prior art.

Referring now to the figures of the drawings in detail and first, particularly, to FIG. 3 thereof, there is seen a prior art rotary printing machine 100 for printing on a web of printing material 1. The web of printing material 1 is transported in a direction of transport T to be treated in a plurality of treatment units. The treatment units or tools are flexographic printing units 11, an embossing unit 12 and a die-cutting and creasing unit 13. The flexographic printing units 11 each include a flexographic printing cylinder 15 with a print sleeve and an impression cylinder 16. The embossing unit 12 has an embossing cylinder 17 and the die-cutting and creasing unit 13 has a die-cutting cylinder 18. The Inspection systems 14, for instance embodied as cameras for continuously monitoring the in-register treatment of the web of printing material 1, are disposed next to the web path of the web of printing material 1. The inspection systems 14 especially monitor the circumferential register and the lateral register.

The inspection systems 14, the flexographic printing units 11, the embossing unit 12 and the die-cutting/creasing unit 13 are connected to a control unit 22 in terms of data communication and may be actuated by the control unit 22.

Figure 1:
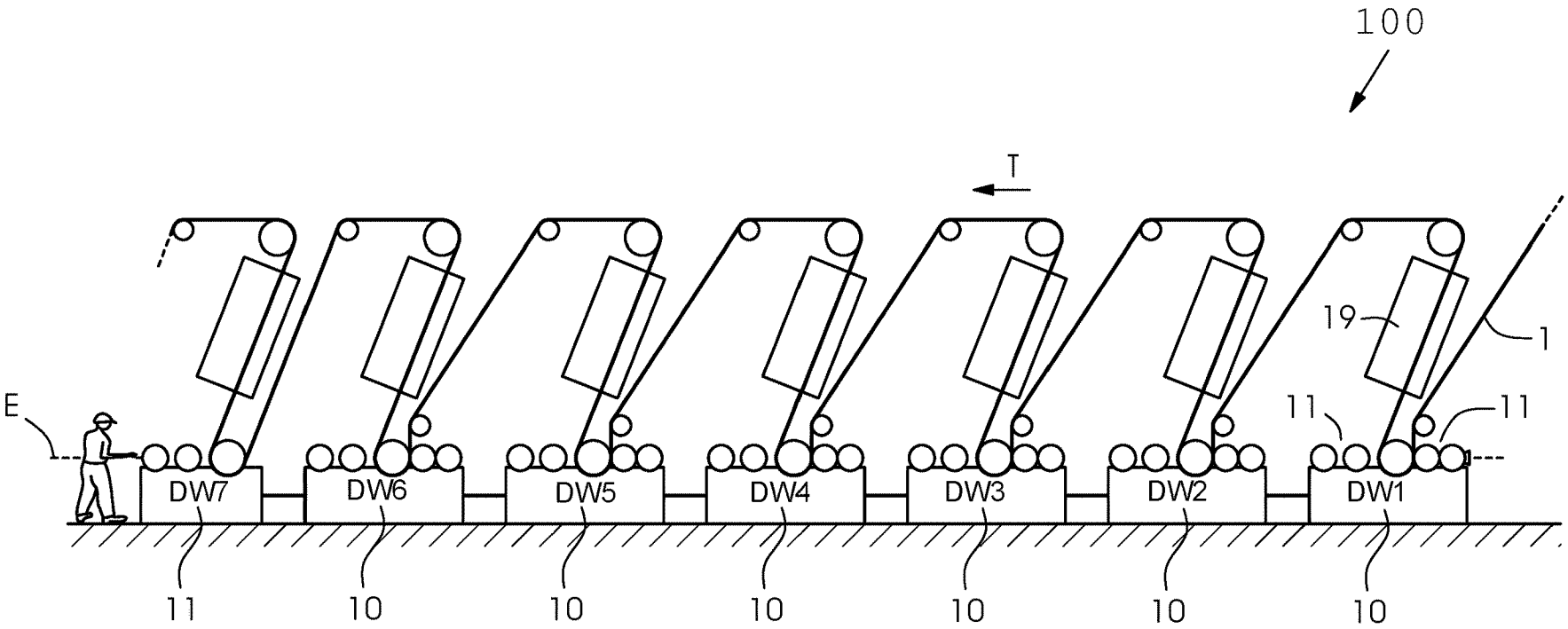
FIG. 1 is a diagrammatic, longitudinal-sectional view of a printing machine of the invention, namely a configuration including six DID stations followed by one SID station.

FIG. 1 is a global representation of a printing machine 100. The printing machine 100 of the invention includes a plurality of flexographic printing units 11. The flexographic printing units 11 print on a web of printing material 1 that is transported in a direction of web transport T. The flexographic printing units 11 have been numbered as DW1 to DW7. The flexographic printing units 11 are in an in-line configuration on a plane E that is easily accessible to a machine operator. Every two flexographic printing units 11 together form a printing station 10, at least for the printing units DW1 to DW6. Such a printing station 10 may also be referred to as a twin printing unit. The printing unit DW7 is embodied as a conventional flexographic printing unit 11 that may for instance apply a continuous layer of varnish. The first printing unit DW1 of the printing station 10 applies the color magenta, the second printing unit DW2 of the printing station 10 applies the color cyan, the third printing unit DW3 of the printing station 10 applies the color yellow and the sixth printing unit DW6 of the printing station 10 applies the color black. The further printing units DW4/DW5 of the printing stations 10 apply special colors S1 and S2. A drier 19 is provided downstream of every printing station 10 in the direction of web travel T.

Like the printing machine 100 in FIG. 3, the printing machine 100 in FIG. 1 may include an embossing unit 12, a die-cutting/creasing unit 13 and a control unit 22 in addition to the flexographic printing units 11.

Figure 2:
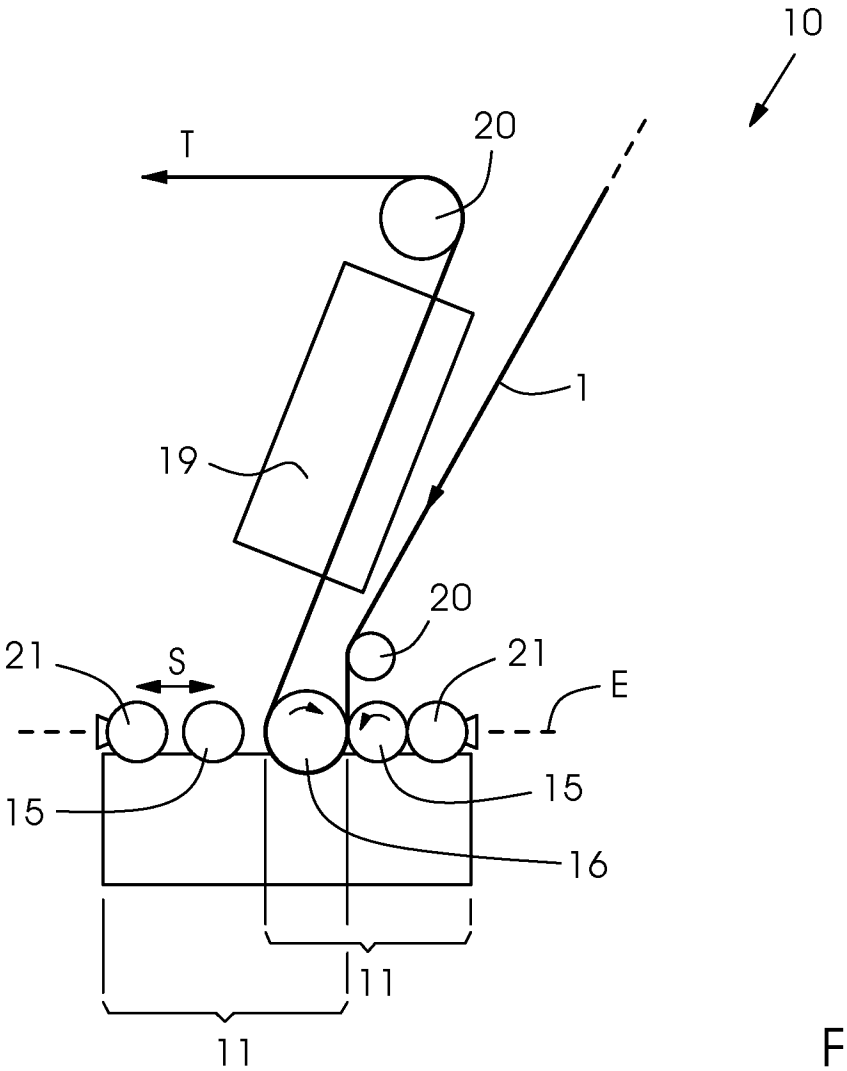
FIG. 2 is an enlarged sectional view of a printing station of the printing machine of FIG. 1.

The construction of a respective printing station 10 is shown in more detail in FIG. 2. A web of printing material 1 that is transported in the direction of web transport T is guided by deflection rollers 20 and wraps around an impression cylinder 16. Two flexographic printing units 11, each one including a flexographic printing cylinder 15 with a print sleeve, an impression cylinder 16, and an ink application device 21, form a printing station 10. The flexographic printing units 11 with their components are disposed in a plane E. The two flexographic printing units 11 have a common impression cylinder 16. The configuration of the flexographic printing cylinders 15 and the ink application devices 21 of the two flexographic printing units is mirror-symmetrical relative to a vertical axis of symmetry through the impression cylinder 16. The printing station 10 is constructed in such a way that one of the two flexographic printing units 11 is actively printing and in an activated position. The other, inactive flexographic printing unit 11 has been disengaged from the common impression cylinder 16. An activation or deactivation of a flexographic printing unit 11 is achieved by an adjustment movement s. In the representations of FIG. 1 and FIG. 2, a first print job is processed in the respective right-hand flexographic printing units 11 of a respective printing station 10. At the same time, a second print job may be prepared or maintenance operations (e.g. a blade change at the doctor blade) may be carried out in the left-hand flexographic printing unit 11 of the printing station 10. When a first job has been completed at some point in time, the right-hand flexographic printing unit 11 automatically moves into an inactive stand-by position and the left-hand flexographic printing unit 11 simultaneously moves into an active position to print the second print job. Thus, the end of a first print job and the beginning of a second, subsequent print job are almost simultaneous. This process, which has been described for a first printing station 10, is implemented in the same way in the further printing stations 10 in a positionally accurate way. This means that the second printing station 10 is switched from the first to the second print job, i.e. from the right-hand flexographic printing unit 11 to the left-hand flexographic printing unit 11 at precisely the location of the web of printing material 1 at which the first printing station 10 has made the switch. This reduces unusable products, i.e. waste. In other words, the flexographic printing units 11 of the various printing stations 10 synchronize in an in-register way, resulting in virtually no waste.

The switch from one print job to the next print job is made in an event-driven way. The triggering event may be a specified printing time, a specified length of the web of substrate that has been printed on, a specified number of printed copies, a change of material, or an initiating operation by the machine operator. Due to such an event-driven control of the printing machine 100 by using a control unit 22, the printing machine 100 is capable of preparing for the next print jobs while processing a current print job and of processing the next print jobs in sequence.

Figure 4:
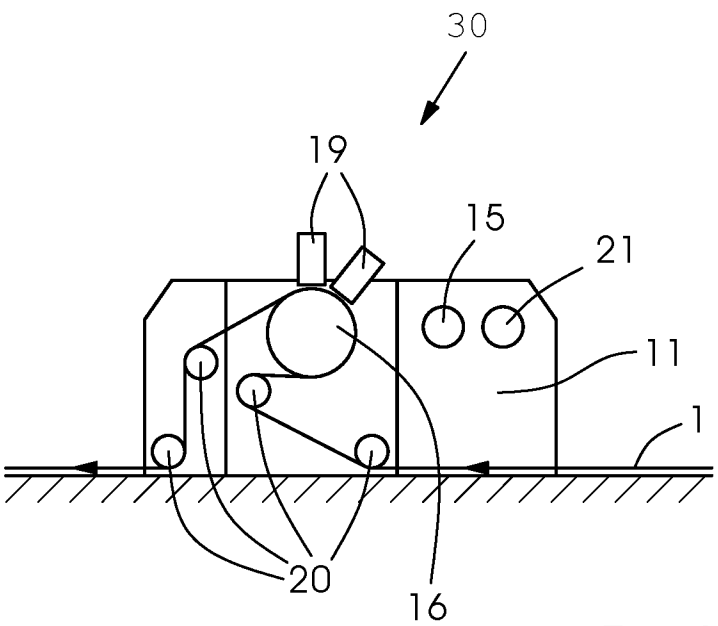
FIG. 4 includes two sectional views illustrating the difference between a DID and an SID station.
Figure 4:
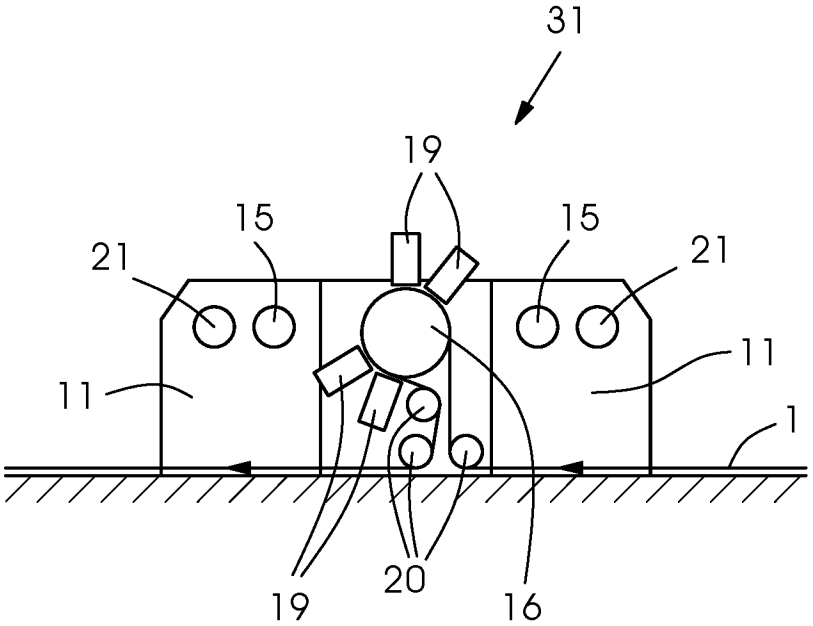

FIG. 4 illustrates the difference between a DID station 31 (left-hand side of the figure) and an SID station 30 (right-hand side of the figure). Such stations may be provided in the configurations shown in the present application (see FIG. 7, for instance).

Both stations are constructed as so-called short web stations: if UV inks are used, the drier path may be chosen to be much shorter; UV driers may in particular be disposed on the circumference of a (central) impression cylinder in a space-saving way. As compared to the thermal drying process of water-based inks (see FIGS. 1, 8, and 9, for instance), the drier path is much shorter. The web path between the stations may furthermore be located in a plane below the plane E that is accessible to the machine operator. The web is thus guided to the stations from below. The short web path between the stations results in an improved register behavior. In addition, the process of starting up the printing machine is shortened to a considerable extent. The (central) impression cylinder is preferably embodied as a cooling cylinder.

The DID station 31 includes the following elements in the direction of printing material transport: a deflection roller 20 for the web 1, a central impression cylinder 16, a first flexographic printing unit 11 (including a flexographic printing cylinder 15 and an ink application device 21 with, for instance, a screen cylinder) assigned to the impression cylinder, one or (as shown) two driers 19, a second flexographic printing unit 11, one or (as shown) two further driers 19, and two deflection rollers 20. The driers are preferably UV driers. Such a station is capable of applying two colors at the same time.

The SID station 30 includes the following elements in the direction of printing material transport: two deflection rollers 20 for the web 1, a central impression cylinder 16, a first flexographic printing unit 11 (including a flexographic printing cylinder 15 and an ink application device 21 such as a screen cylinder) assigned to the impression cylinder 16, one or (as shown) two driers 19, and a deflection roller 20. The driers are preferably UV driers. Such a station is capable of applying one color. The other unit of the station may at the same time (i.e. on the fly) be subjected to changeover operations such as a plate and/or color change.

Figure 5:
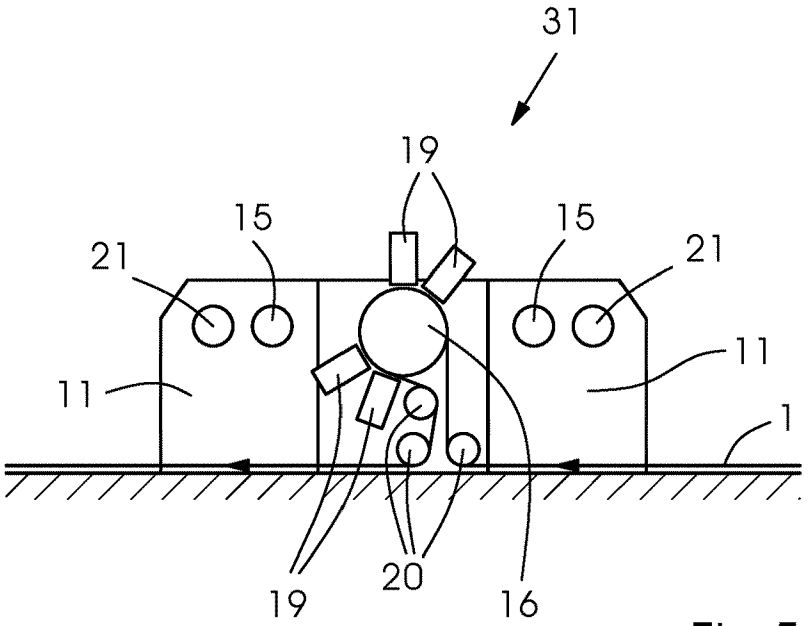
FIG. 5 is a sectional view illustrating a DID station with two flexographic printing units that may be activated simultaneously.

FIG. 5 illustrates a DID station with two flexographic printing units 11 that are simultaneously activatable. One or (as shown) two driers 19 are disposed downstream of every flexographic printing unit 11 on the (central) impression cylinder 16. The driers are preferably UV driers.

Figure 6:
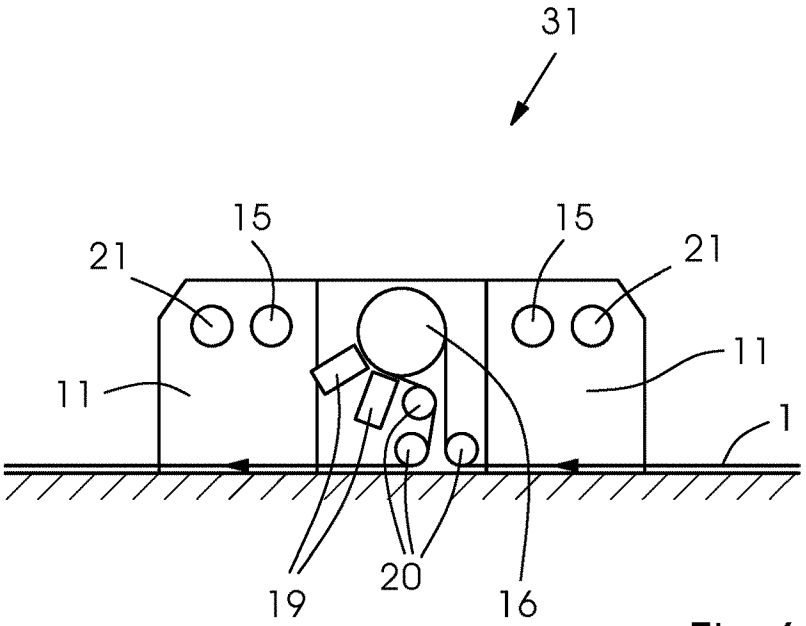
FIG. 6 is a longitudinal-sectional view of a DID station with two flexographic printing units that may be activated in an alternate way.

FIG. 6 illustrates a DID station with two flexographic printing units 11 that are alternately activatable. One or (as shown) two driers 19 are disposed downstream of the last flexographic printing unit 11 on the (central) impression cylinder 16. The driers are preferably UV driers.

Figure 7:
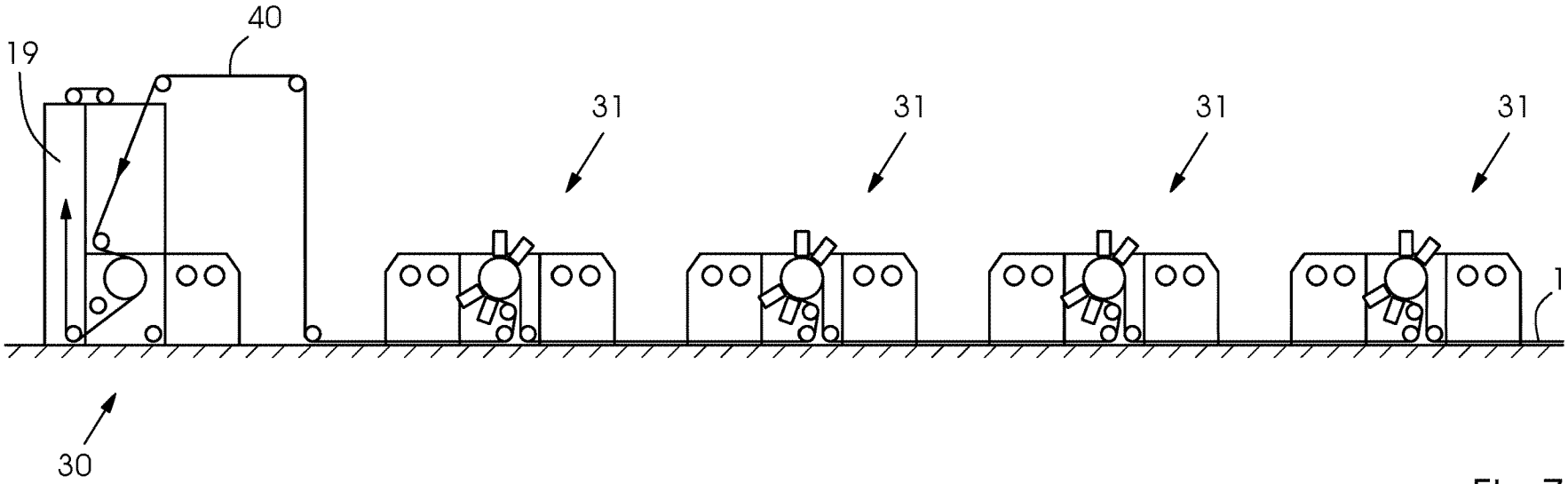
FIG. 7 is a longitudinal-sectional view of a so-called gable top application.

FIG. 7 illustrates a further application, namely a machine including 4 DID short web stations 31, one SID station 30, and finally a thermal drier 19. Eight colors and a varnish or silicone may be applied. A web-guiding element 40 is provided between the last station 31 and the station 30. Such a configuration is used for instance to produce so-called gable top packaging.

Figure 8:
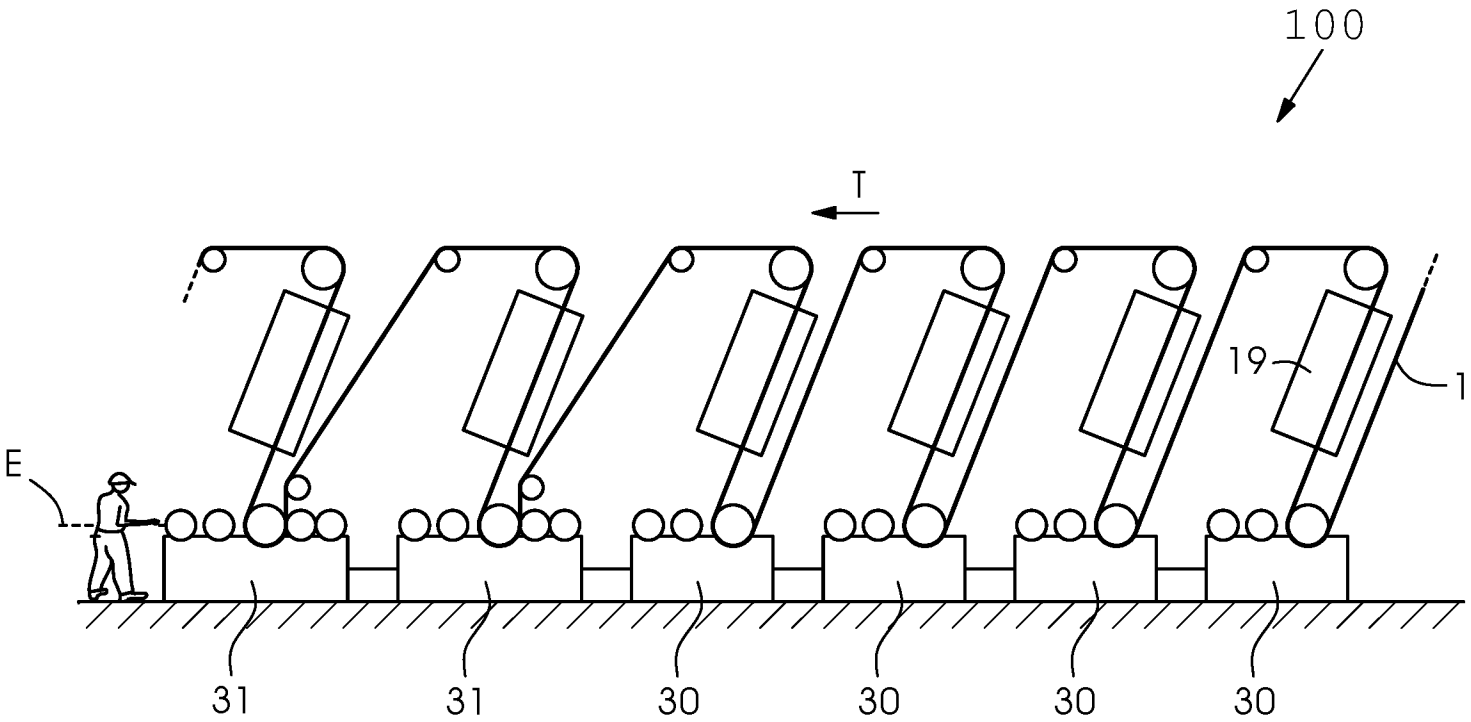
FIG. 8 is a longitudinal-sectional view of a configuration with four SID stations followed by two DID stations.

FIG. 8 illustrates a configuration including four SID stations 30 followed by two DID stations 31. Every station is assigned a thermal drier 19. The web is guided to the stations from above. The printing sequence may be as follows: CMYK process colors, special color 1, special color 3. The special color units may be changed to other special colors 2 and 4 while the production run continues.

Figure 9:
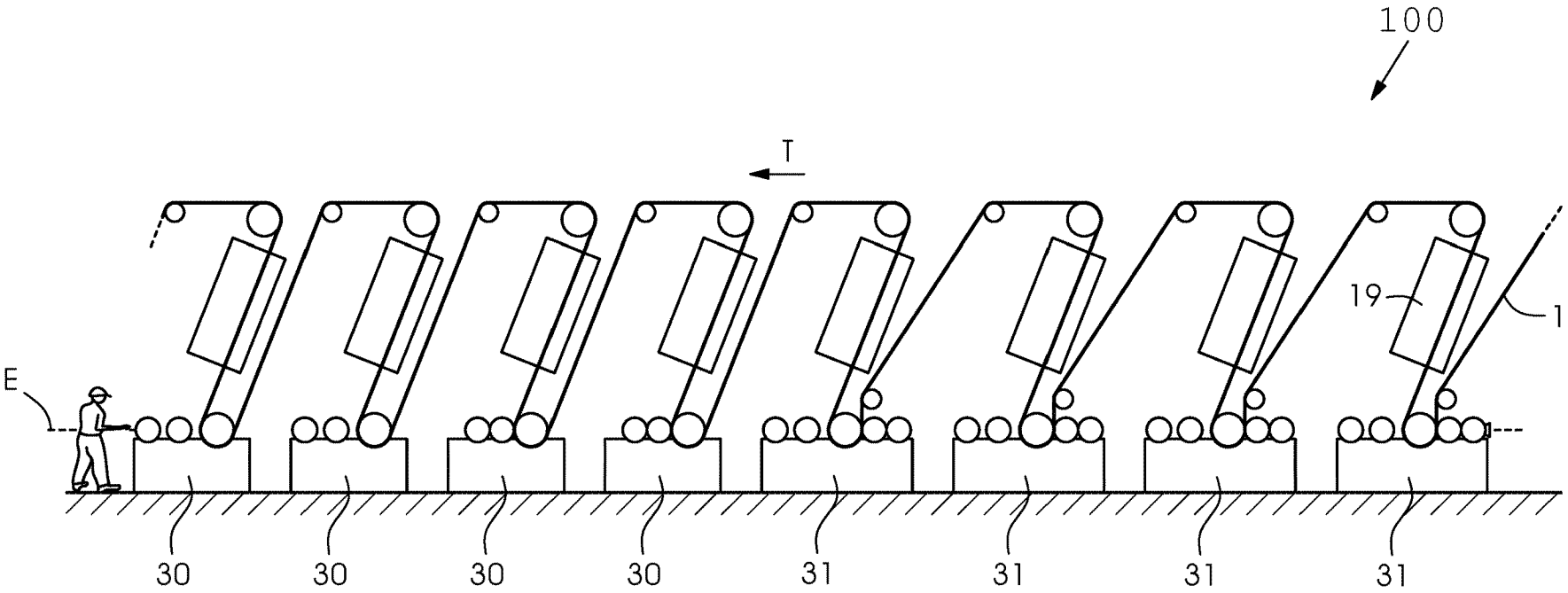
FIG. 9 is a longitudinal-sectional view of a configuration with four DID stations followed by four SID stations.

FIG. 9 illustrates a configuration including four DID stations 31 followed by four SID stations 30. Every station is assigned a thermal drier 19. The web is guided to the stations from above. The printing sequence may be as follows: CMYK process colors, special color 1, special color 2. The two last stations 30 are inactive and are prepared for a following print job or subjected to other changeover operations (special colors 3 and 4).

The following is a summary list of reference numerals and the corresponding structure used in the above description of the invention:

1 web of printing material
10 printing station
11 flexographic printing unit
12 embossing unit
13 die-cutting and creasing unit
14 inspection system
15 flexographic printing cylinder with printing sleeve
16 impression cylinder
17 embossing cylinder
18 die-cutting cylinder
19 drier
20 deflection roller
21 ink application device
22 control unit (machine control with interface)
30 SID station (single ink deck)
31 DID station (double ink deck)
40 web path
100 printing machine
s adjustment movement
E plane
T direction of web transport
DW printing unit number
M magenta
C cyan
Y yellow
K black
S1, S2 special colors

The invention claimed is:

1. A printing machine for printing on a continuous web of printing material, the printing machine comprising:

a plurality of in-line flexographic printing units disposed in a plane accessible to a machine operator;

every two of said flexographic printing units of said plurality of flexographic printing units together forming a first double printing station or a second double printing station;

said two flexographic printing units of a respective double printing station having a common impression cylinder; and said flexographic printing units in said first and second double printing stations being synchronized precisely in accordance with a register when changing print jobs to cause a switching from a first print job to a second print job and therefore a switching from one flexographic printing unit to another flexographic printing unit in said second double printing station to take place precisely at a point on the web of printing material where said first double printing station has completed a change.

2. The printing machine according to claim 1, wherein said two flexographic printing units of a respective double printing station are jointly activatable or alternately activatable.

3. The printing machine according to claim 1, wherein said two flexographic printing units of a respective double printing station are disposed mirror-symmetrically relative to said common impression cylinder.

4. The printing machine according to claim 1, which further comprises a drier disposed downstream of every respective double printing station or one, two or four driers included in every respective double printing station.

5. The printing machine according to claim 4, wherein said drier is a UV drier or said driers are UV driers.

6. . The printing machine according to claim 4, wherein said common impression cylinder of each respective double printing station is a cooling cylinder.

7. The printing machine according to claim 6, wherein said cooling cylinder has a circumference and:

a flexographic printing unit,
one or two UV driers,
another flexographic printing unit and
one or two other UV driers
are disposed along said circumference of said cooling cylinder in every double printing station in a direction of printing material transport.

8. The printing machine according to claim 1, wherein one of said flexographic printing units is equipped with an ink application device and a flexographic printing cylinder.

9. The printing machine according to claim 1, wherein each respective impression cylinder has a circumference smaller than 1000 mm.

10. The printing machine according to claim 1, which further comprises at least one further flexographic printing unit in addition to said plurality of flexographic printing units, said at least one further flexographic printing unit being a single printing station.

11. The printing machine according to claim 10, wherein said single printing station is a varnishing unit.

12. The printing machine according to claim 10, wherein:
said single printing station is disposed upstream of said plurality of flexographic printing units or
said single printing station is disposed downstream of said plurality of flexographic printing units.

13. The printing machine according to claim 10, wherein said single printing station is disposed downstream of said double printing station or downstream of a last double printing station in a direction of printing material transport.

14. The printing machine according to claim 13, wherein:
said single printing station has an impression cylinder being a cooling cylinder having a circumference; and
a flexographic printing unit and one or two UV driers are successively disposed along said circumference of said cooing cylinder in said direction of printing material transport.

15. The printing machine according to claim 13, which further comprises a hot-air drier, said single printing station and said hot-air drier being successively disposed downstream of said last double printing station in said direction of printing material transport.

16. The printing machine according to claim 10, wherein:
said plane is a first plane; and
a section or all sections of the web of printing material are disposed in a second plane located substantially beneath said first plane and disposed at least one of:
a) between two double printing stations or
b) between a double printing station or a last double printing station and said single printing station.

17. The printing machine according to claim 16, wherein a length of the section or all sections of the web of printing material is smaller than a length of the web of printing material in a double printing station.

18. The printing machine according to claim 16, wherein the web of printing material forms a loop extending from said second plane and being open in a downward direction in every double printing station.

19. The printing machine according to claim 16, which further comprises at least two or three guide rollers disposed between said first plane and said second plane and causing the loop to run around said impression cylinder and said guide rollers.

20. A method of operating a printing machine for printing on a continuous web of printing material, the method comprising the following steps:
providing a plurality of in-line flexographic printing units disposed in a plane accessible to a machine operator, every two of the flexographic printing units of the plurality of flexographic printing units together forming a double printing station, and the two flexographic printing units of a respective double printing station having a common impression cylinder;
activating and printing with only one flexographic printing unit of the two flexographic printing units of a respective double printing station while carrying out an equipping procedure or a maintenance procedure on the other flexographic printing unit in the respective double printing station; and
activating and deactivating the two flexographic printing units in a respective double printing station precisely in accordance with a register.

21. The method for operating a printing machine according to claim 20, which further comprises subjecting the other flexographic printing unit of the respective double printing station to set-up operations.

22. The method for operating a printing machine according to claim 20, which further comprises automatically placing the one flexographic printing unit in an inactive standby position while placing the other flexographic printing unit in an active position when a first print job has been completed at a specific time in order to print a second print job, causing a completion of printing for the first print job and a start of printing for the second, subsequent print job, to take place simultaneously.

* * * * *